US008657275B2

(12) United States Patent
Fan et al.

(10) Patent No.: US 8,657,275 B2
(45) Date of Patent: Feb. 25, 2014

(54) MATERIAL-SAVING AND ENERGY-SAVING MULTIFUNCTIONAL BENCH CLAMP

(76) Inventors: Chaolai Fan, Beijing (CN); Yongjie Fan, Beijing (CN)

( * ) Notice: Subject to any disclaimer, the term of this patent is extended or adjusted under 35 U.S.C. 154(b) by 350 days.

(21) Appl. No.: 12/811,084

(22) PCT Filed: Nov. 6, 2008

(86) PCT No.: PCT/CN2008/072970

§ 371 (c)(1),
(2), (4) Date: Jun. 28, 2010

(87) PCT Pub. No.: WO2009/067896

PCT Pub. Date: Jun. 4, 2009

(65) Prior Publication Data

US 2010/0320670 A1 Dec. 23, 2010

(30) Foreign Application Priority Data

Nov. 9, 2007 (CN) ..... 2007 1 0166135

(51) Int. Cl.
*B25B 1/00* (2006.01)
*B25B 5/10* (2006.01)
*B25B 1/02* (2006.01)

(52) U.S. Cl.
USPC ..... 269/153; 269/240; 269/172

(58) Field of Classification Search
USPC ..... 269/43, 45, 153, 172, 240, 271
See application file for complete search history.

(56) References Cited

U.S. PATENT DOCUMENTS 4,133,519 A * 1/1979 Shin et al. ..... 269/247
5,282,392 A 2/1994 Fan et al.
7,677,141 B1 * 3/2010 Crew ..... 81/302

* cited by examiner

*Primary Examiner* — Lee D Wilson
*Assistant Examiner* — Seahee Yoon
(74) *Attorney, Agent, or Firm* — Andrew W. Chu; Craft Chu PLLC

(57) ABSTRACT

A material-saving and energy-saving multifunctional bench clamp includes a movable clamp body, a fixed clamp body and a transmission pair of a screw and a nut. The fixed clamp body is provided with a holding accessory and a retractable locating-guiding device. The movable clamp body is made up of a left part and a right part. The left part is provided with two work heads, each head includes holding members, which form a holding assembly together with the accessories installed on the fixed clamp body. At least two axially locating-guiding key grooves are shaped on the cylinder guide rail of the right part and positioned the corresponding work heads of the left part. The bench clamp not only reduces processing surfaces and costs, but also saves about 30% material of clamper body under the same standard size and rated clamp force by comparison to the old multifunctional bench clamp.

5 Claims, 5 Drawing Sheets

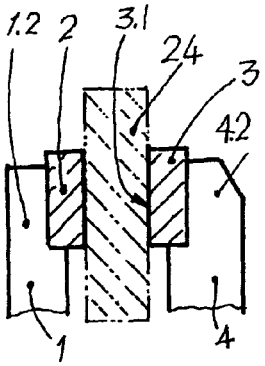
FIG. 6-1
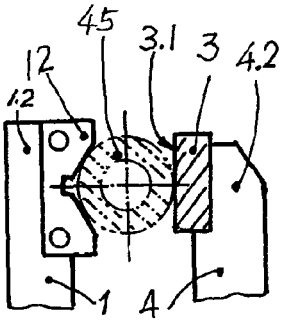
FIG. 6-2
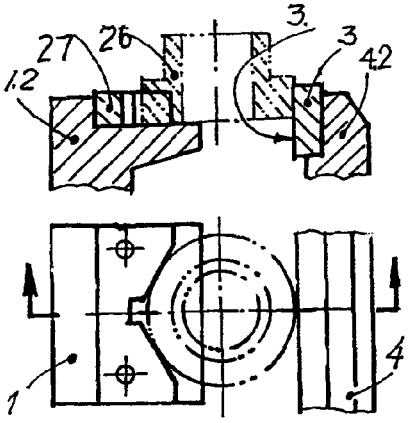
FIG. 6-3
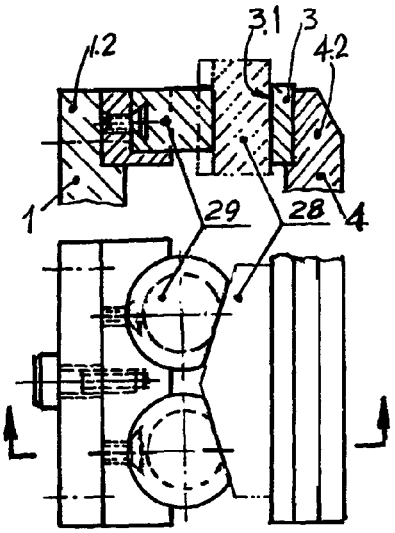
FIG. 6-4
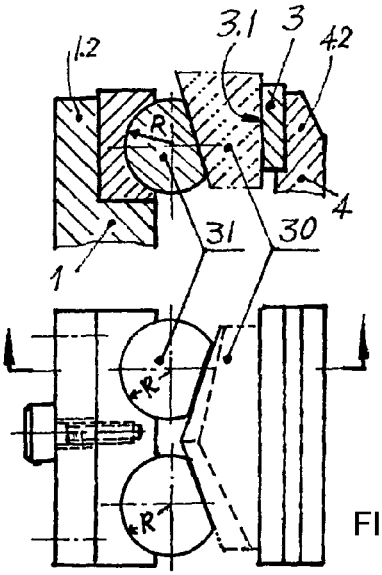
FIG. 6-5
FIG. 7
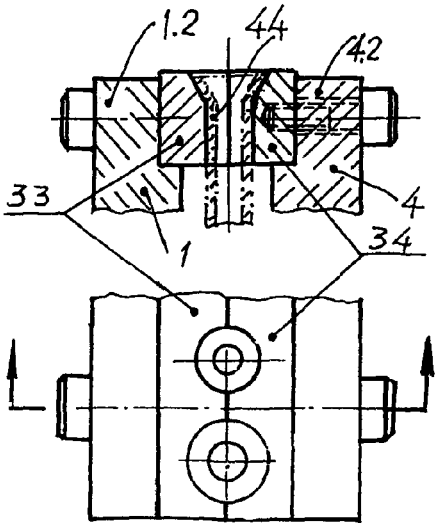

MATERIAL-SAVING AND ENERGY-SAVING MULTIFUNCTIONAL BENCH CLAMP

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

This invention belongs to a field of clamping fixture, particularly to a material-saving and energy-saving multifunctional bench clamp.

2. Description of Related Art Including Information Disclosed Under 37 CFR 1.97 and 37 CFR 1.98.

A bench clamper (or a bench clamp) is a kind of ancient clamping fixture and, one of the most fundamental tools that workers most often use for set-up and repair and in car garages. Due to shapes of work pieces held by bench clamps, including the most ordinary rectangles with every kind of thickness, tubes (cylinders) in every kind of diameters, and work pieces with irregular shapes and specially used in particular and professional situations, bench clamps account for a lot functions, and therefore, bench clamps, by use, can be generally classified to four classes, i.e., ordinary bench clamps, bench clamps for clamping tubes, multifunctional bench clamps and specially used bench clamps.

Ordinary bench clamps and bench clamps for clamping tubes as work pieces, are mostly used for clamping rectangles and tubes or cylinders, respectively. The respective clamps have their own functions, different from each other and others. However, multifunctional bench clamps include combinations with the above bench clamp; i.e., a multifunctional bench clamp is very useful to users for both functions of the above bench clamps (the ordinary bench clamps and the bench clamps for clamping tubes) at the same time.

FIG. 1-1 is a main view of the basic structure of a typical multifunctional bench clamp (note: irons (16) & (17) of the mouth of the clamp are now at the upper first workplace, i.e., the workplace drawing while primarily clamping rectangle work pieces). FIG. 1-2 is a cross-sectional view in an A-A direction of FIG. 1-1. FIG. 1-3 is a drawing of parts of a nut (19) in FIG. 1-1, including a main view and a cross-sectional view in a B-B direction. FIG. 2 is a workplace drawing at the second workplace of a typical multifunctional bench clamp in FIG. 1-1 (note: the workplace drawing while primarily clamping cylindrical work pieces, e.g., tubes).

The typical multifunctional bench clamp in FIG. 1-1 has two groups of work heads, (14.1) and (15.1) and (14.2) and (15.7), which are rotatable simultaneously. Its structure primarily comprises a movable clamp body (14), a middle clamp body (15), a fixed clamp body (18), a screw (11), a hanging armed key typed nut (19), a retractable locating-guiding device (9) and two groups of holding members (16)/(17) and (22)/(21). To position the first workplace and the second workplace is accomplished in the way that an end of locating-guiding device (9.1) plugs in a positioning hole (15.4) or (15.5) on the middle clamp body (15). Although the typical multifunctional bench clamps have been used widely for almost one hundred years, they have three drawbacks in their structure and working principle as below:

First, because a typical multifunctional bench clamp is composed of a concentric sleeved structure with three layers of a movable clamp body (14), a middle clamp body (15) and a fixed clamp body (18), to add a layer every time will always cost money and increase weight. Additionally, the upper section of the movable clamp body and middle clamp body needs to process a milling, slitting key slot (14.4) and, therefore, consumes more materials and adds up manufacture costs. This kind of bench clamp needs higher precision in the process, and there is relatively complex art.

Second, because there is a long journey slitting key groove (14.4) milled on the sleeved tube (14.3) of the movable clamp body, it makes the cross-sectional shape of the sleeved tube (14.3) to be a 'c' type with a gap, thereby weakening the strength of that sleeved tubes (the main body which be executed force); it only increases thickness of walls of the sleeved tube (14.3) of the movable clamp body to compensate. However, this not only adds up weights but also increases the consumption of materials and makes a lot of trouble to process the long milling, slitting key groove (14.4).

Thirdly, structure of the nut (19) inside bench clamp is very complicated and costs a lot to manufacture. Please see FIG. 1-2 and FIG. 1-3 for details, the nut (19) is compound of three functional parts: the body of the nut (19.2), a guide key (19.1) which is slidingly matched with the slitting key groove (14.4) and a flange (19.3) which is fixed with screws on the right end surface of the middle clamp body (15). The above-mentioned three parts are actually combined to be an integral hanging armed nut (19), and the left circularly ringed end surface (19.3*b*) of the flange (19.3) of the nut is slidingly matched with the right end surface (18.1) of the fixed clamp body (18). When the nut (19) is executed axial pull force from the screw (11), it is transmitted in a hanging armed way with unbalanced charges from the guide key (19.1) and the left side (19.3*b*) of the cover of the flange onto the fixed clamp body (18). Then, the thickness of the guide key (19.1) of the nut (19) in a hanging armed way with unbalanced charges has to be very large, and correspondingly, the key groove slidingly matched with the guide key becomes wider and therefore other related parts will be increased, e.g., the thickness of the walls of the movable clamp body with a 'c' shaped sleeved cross-section will also be increased. Above all, those will greatly increase the consumptions of raw materials and energy and add costs to manufacture. Therefore, the above mentioned drawbacks and many inconveniences thereof in the old multifunctional bench clamps have to bring about a new kind of material-saving and energy-saving multifunctional bench clamps which can overcome the above mentioned material-consuming and energy-consuming drawbacks.

In general, the panels are maintained by masts, each mast comprising of a profile, or an assembly of profiles; and comprising means designed capable of permitting to fasten, directly or indirectly, one or several panels, or accessories such as, non-restrictively, racks. Thus, a mast includes longitudinal retaining grooves aimed at receiving either a portion of the panel to be carried or an element permitting to hook the panel thereon.

Irrespective of their design, all presently known modular partition systems have the same drawback, namely that each mast remains visible, and constitutes an interruption of the image, the more when it is arranged between at least two panels, and the more when said at least two panels serve as a support for only one image.

SUMMARY OF THE INVENTION

This invention is to solve the technical problem, such as, simplifying the structure of an old multifunctional bench clamp, lowering its weight, reducing the consumptions of materials and energy, and making functions of the bench clamp diversify at lower costs, i.e., one clamp, more functions.

To solve the above technical problem, this invention describes a new structure type material-saving and energy-saving multifunctional bench clamp. The old structure of three-layered circular sleeves is changed to two-layered circular sleeves, therefore greatly lowering the weight and saving raw materials. Additionally, a large slitting key groove on the sleeve of the movable clamp body is changed to a shallow, regular key groove and a non-slitting key groove, thereby greatly increasing the strength of the sleeve of the movable clamp body, reducing its size, and then saving a lot of raw materials. In practice, whilst being the same size, the bench clamp saves about 30% of the weight. Furthermore, to cancel the complicated-structured hanging armed key nut, which combines three functional parts into an integral unit, is also a factor to greatly reduce, by about 20%, the manufacture cost. The technical solutions are as follows:

The material-saving and energy-saving multifunctional bench clamp, comprises a movable clamp body, a fixed clamp body and, correspondingly, a transmission pair of a screw and a nut, said fixed clamp body being provided with holding accessories and being retractably movable locating-guiding apparatus. The movable clamp body is composed of two of the left and right parts, wherein the right part is a cylinder guide rail in sleeve form and slidingly matched with an inner opening of the fixed clamp body. The left part is provided with at least two work heads, each head having a set of holding members installed thereon, which form a pair of a holding assembly together with a holding accessory installed on said fixed clamp body, so as to clamp, in combination, a work piece firmly between said movable clamp body and said fixed clamp body.

Preferably, an outer cylinder guide rail surface of said cylinder guide rail on the right part of said movable clamp body is provided with at least two longer journey axially locating-guiding key grooves which are used for positioning the workplace of the corresponding work heads.

Preferably, said holding accessories (or members) of said fixed clamp body and said movable clamp body are rectangular irons of mouths of clamps or, 'V' type holding blocks, and the holding accessories (or members) are changeable, respectively.

More preferably, the holding accessories (or members) of said fixed clamp body are developed to be unchangeable or called common, rectangular irons of mouths of clamps, whereas only every kind of holding members installed on said movable clamp body are changed into rectangular, V-type, semi-circular, curved or spherical holding blocks.

More preferably, the nuts are patented products, titled 'Fan's Rapid and Automatic Opening and Closing Nuts', which have achieved invention patent certificates from over 20 countries under the PCT. Their patent certificate numbers include CN 95194620X in P.R. China, US5970812 in U.S.A., DE 69524603 T2 in Germany, EP 0774599 B1 in E.U., and 1835443 in Japan.

By comparison with previous art, the present invention has advantages as follows: the new structure not only decreases weight and saves raw materials, but also reduces a processing surface, greatly saving human costs in the process. In comparison to old slitting (cutting through) key grooves, which are both long and large, shallow grooves, which are cut in a cylindrical sleeved sliding guide rail greatly increase the strength of anti-flexural torque, when force effect is identical, the thickness of walls of the sleeve could be reduced, thus saving materials. In the meantime, using simply structured, good force effected, patented nuts can overcome the development drawback in hanging armed nuts used by old multifunctional bench clamps.

BRIEF DESCRIPTION OF THE DRAWINGS

FIG. 1-2 is a cross-sectional view along Line A-A in FIG. 1-1.

FIG. 1-3 is a cross-sectional view and top plan view, respectively, of parts of a nut (19) in FIG. 1-1, the cross-sectional view being along Line B-B of FIG. 1-2.

FIG. 2 is another cross-sectional view of the typical multifunctional bench clamp in FIG. 1-1 (note: the workplace drawing while primarily clamping cylindrical work pieces, e.g., tubes).

FIG. 3-1 is a cross-sectional view of a multifunctional bench clamp according to this invention, i.e., whilst at the first workplace, the workplace drawing when primarily clamping rectangle work pieces.

FIG. 3-2 is a cross-sectional view along Line C-C in FIG. 3-1.

FIGS. 5-1, 5-2 and 5-3 are schematic views of a work head. The figures show a movable clamp body according to the invention which is provided with a plurality of work heads, wherein: as shown in FIG. 5-1, two work heads (35) and (36); as shown in FIG. 5-2, three work heads (37), (38) and (39); and, as shown in FIG. 5-3, four work heads (40), (41), (42) and (43).

FIGS. 6-1, 6-2, 6-3, 6-4, and 6-5 are schematic and sectional views of a portion of the multifunctional bench clamp according to the invention as shown in the main view of FIG. 3-1, showing one of the more preferable technical solutions, i.e., holding accessories (3) on the fixed clamp body (4) being developed to be unchangeable and having different shapes.

FIG. 7 is a partial cross-sectional view and partial schematic view of a bench clamp, showing a technical solution to which both holding accessories (34) on the fixed clamp body (4) and holding members (33) on the movable clamp body (1) are changeable, in an example of a multifunctional bench clamp according to the invention as shown in the main view of FIG. 3-1.

DETAILED DESCRIPTION OF THE DRAWINGS

According to accompanying drawings and in cooperation with preferable embodiments, other aims, details, characteristics and advantages of the present invention will become clearer. The embodiments below are only exemplary but not limited in application.

Embodiment I

Figure 1:
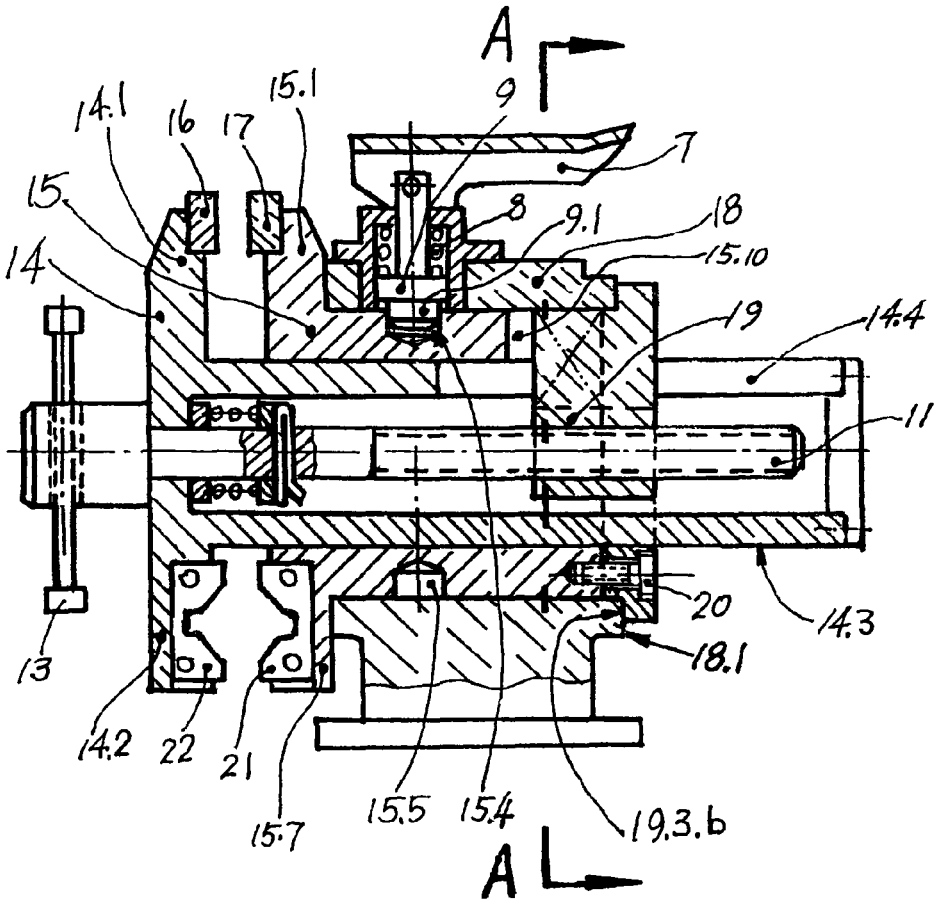
FIG. 1-1 PRIOR ART
FIG. 1-1 is a cross-sectional view of the basic structure of an old multifunctional bench clamp (note: irons (16) & (17) of the mouth of the clamp are now at the upper first workplace, i.e., the workplace drawing while primarily clamping rectangle work pieces).
Figures 1, 2:
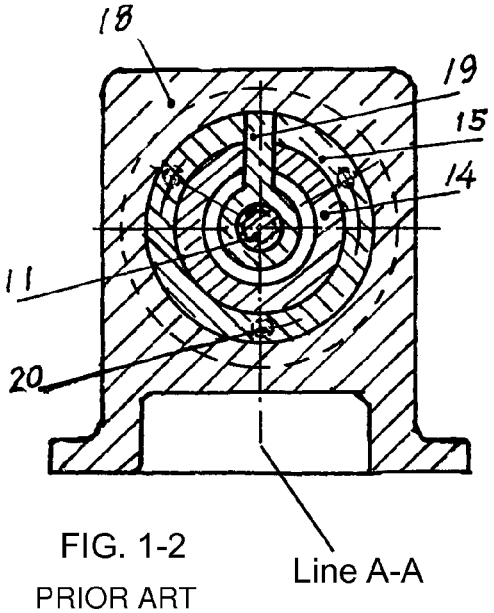
FIG. 1-2 PRIOR ART
Figures 1, 2, 3:
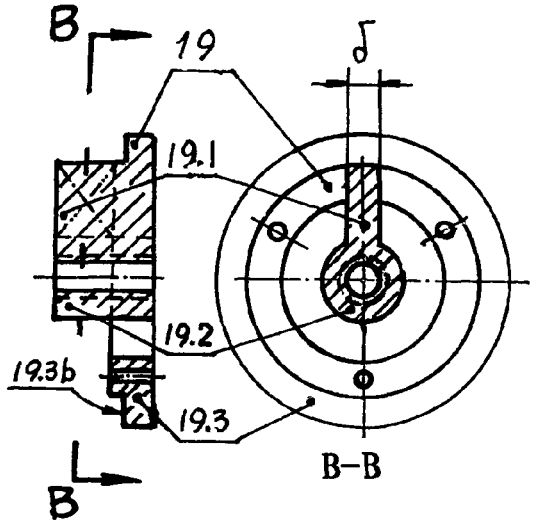
FIG. 1-3 PRIOR ART
Figure 2:
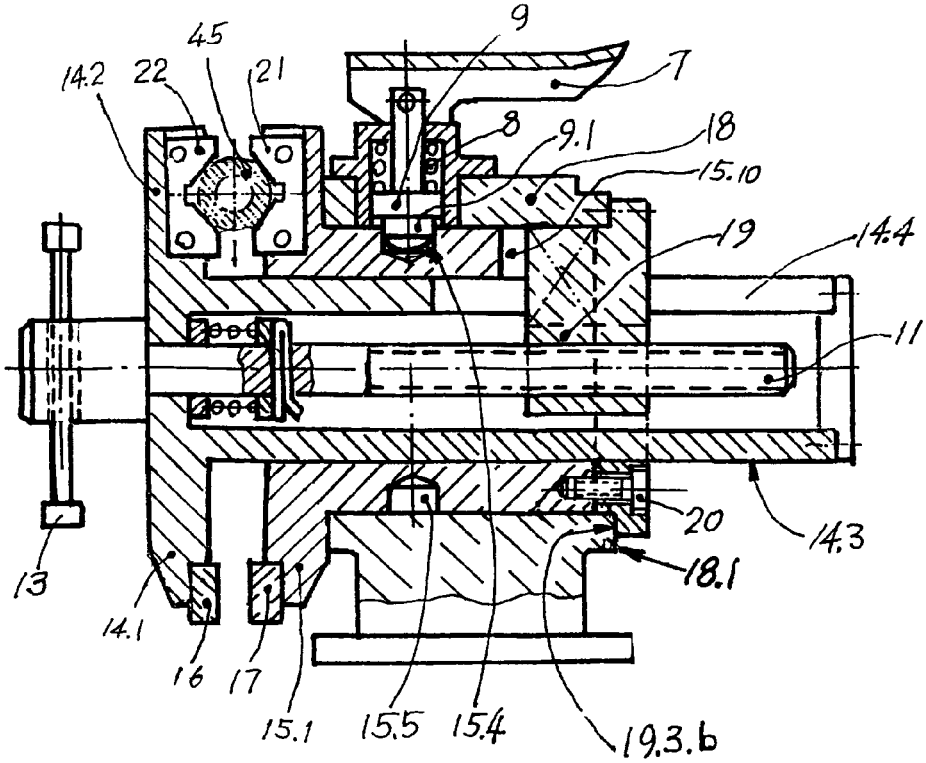
FIG. 2 PRIOR ART
Figures 1, 3:
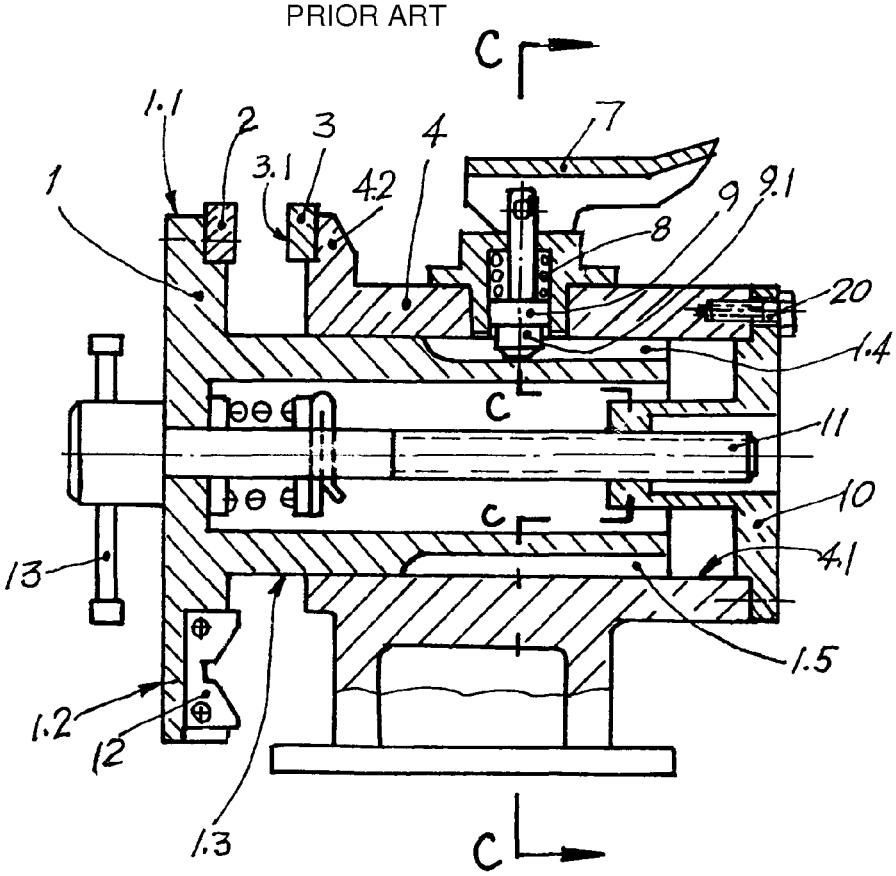
Figures 2, 3:
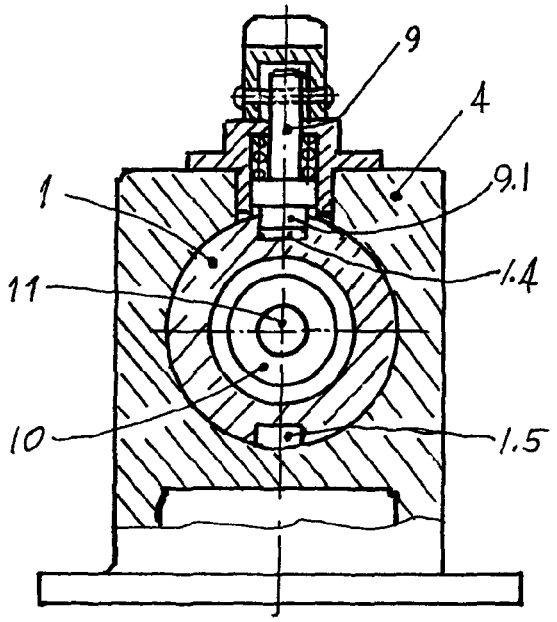
Figure 4:
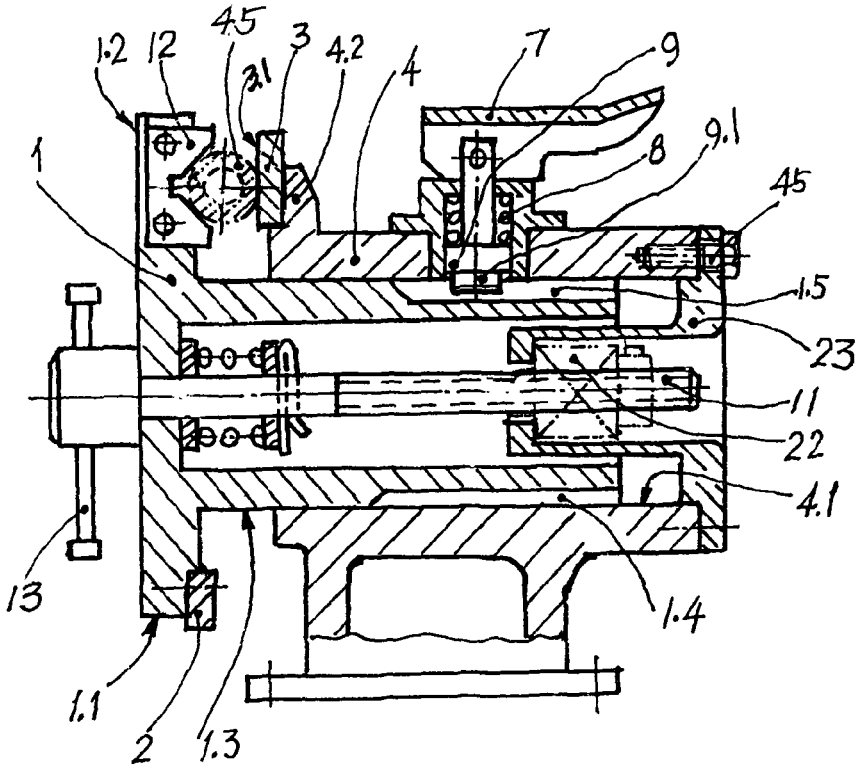
FIG. 4 is another cross-sectional view of the multifunctional bench clamp according to the invention, i.e., at the second workplace while primarily clamping cylindrical work pieces, e.g., tubes.

According to FIGS. 3 and 4, there is a preferable embodiment, i.e., a multifunctional bench clamp, including a movable clamp body (1), a fixed clamp body (4) and correspondingly a transmission pair of a screw (11) and a nut (10).

In the multifunctional bench clamp, the movable clamp body (1) is made up of a left part and a right part. The right part is a cylinder guide rail (1.3) of sleeve form, which is slidingly matched with an inner opening (4.1) of the fixed clamp body (4). The left part is provided with at least two work heads (1.1) and (1.2); each head includes a set of holding members, e.g., an iron of a mouth of a clamp (2) and a 'V' shaped holding block (12), etc., which form a holding assembly together with the accessory (3) installed on the fixed clamp body (4) , so as to clamp, in combination, a work piece firmly between the movable clamp body (1) and the fixed clamp body (4).

On the outer surface of the cylinder guide rail of the right part of the movable clamp body, there are provided with at least two axially locating-guiding devices with longer journey, they may be, such as guiding key grooves, for positioning the corresponding work heads on the left part. The widths of these guiding key grooves are developed under the requirement of fluctuating locating-guiding latches or guiding keys installed on the fixed clamp body to be slidingly matched.

The fixed clamp body (4) is provided with holding accessories (3), which, in the same reason, are an iron of the mouth of the clamp and a 'V' shaped holding block, etc., and with retractable locating-guiding device (9), which could be a locating latch or locating key (in this embodiment, it is a locating key (9.1)). A locating-guiding latch is provided with a retractable device: when it is in a contract state, it is pulled out from the guiding key groove (1.4), the movable clamp body could rotate freely in the opening of the fixed clamp body. When it is in an extension state, it is plugged in the newly selected guiding key groove, at that time, the movable clamp body, under effect of a transmission pair of screw (11) and nut (10), through the guiding key groove relative to the fixed clamp body axially moves back and forth, and makes the specially used holding accessories on a workplace move simultaneously, to accomplish the clamping or relaxing of a work piece. The nut (10) has a simple structure, which can be fixed firmly only through a screw (20) onto the right end surface of the fixed clamp body (4), and good force effect since the force of the nut (10) is evenly transmitted by an axial pull force of the screw (11) to the right end surface of the fixed clamp body (4), thereby overcoming the drawbacks in a force effect by a single hanging arm of a typical nut (19) in an old multifunctional bench clamp as shown in FIG. 1-1, and those further known in the structure of FIGS. 1-2 and 1-3. On the contrary, the size of nuts (10), which are used in the present invention, could be made smaller due to the even force effect, thereby saving raw materials. When, at work, the eccentric operating handle (7) rotates to the leveled position, the locating latch (9) is in the lowest position, and then the lower guiding end (9.1) of the locating latch (9) is plugged in the key groove (1.4). Because the size of the lower guiding end (9.1) just can be movable matched with that of the key groove (1.4) or other many key grooves (1.5), the movable clamp body (1), under the effect of the screw, in the direction of the key groove and in an axial direction, has to move back and forth, to the left or to the right, thereby clamping or relaxing work pieces between the two holding accessories (2) and (3). In the same reason, the eccentric operating handle (7) rotates to the vertical position, the locating latch (9) then is in the highest position and, at this time, the lower guiding end (9.1) of the locating latch (9) is pulled out of the key groove (1.4) upwardly. Thus, the outer cylinder guiding rail (1.3) of the movable clamp body can rotate in any direction inside the inner opening (4.1) of the fixed clamp body (4). Thus, the functionality can be accomplished by selecting another key groove (1.5) to rotate to the lower of the locating latch (9), and then, when the operating handle (7) makes itself to the leveled position, the locating latch (9) falls down under the effect of the springs (8), causing the lower guiding end (9.1) enter another key groove (1.5) of the movable clamp body, another work head (1.2), equipped with the 'V' shaped holding block member (12), of the corresponding movable clamp body (1) will rotate to the upper place as shown in FIG. 4. At this time, if the screw (11) rotates by a handle (13) in a clockwise direction, then the 'V' shaped holding block (12) and the iron of the mouth of clamp (3) on the fixed clamp body can hold cylindrical (or tubular) work pieces (21). If the screw (11) rotates by a handle (13) in a counterclockwise direction, then work pieces can be released.

Embodiment II

Another embodiment of the present invention is a solution that, on the basis of Embodiment I, at present, work heads on the movable clamp body (1) are changed from the primary two heads, to three, four or more heads. That is, FIG. 5 is an illustrative diagram showing that the movable clamp body (1) according to the invention is provided with a plurality of work heads, such as: two work heads (35) and (36) as shown in FIG. 5-1; three work heads (37), (38) and (39) as shown in FIG. 5-2; and, four work heads (40),(41),(42) and (43) as shown in FIG. 5-3.

Figures 1, 5:
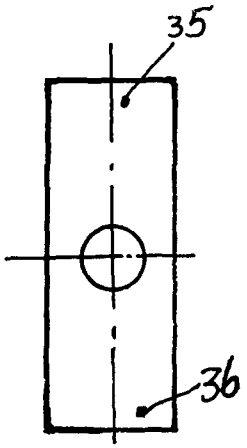
Figures 2, 5:
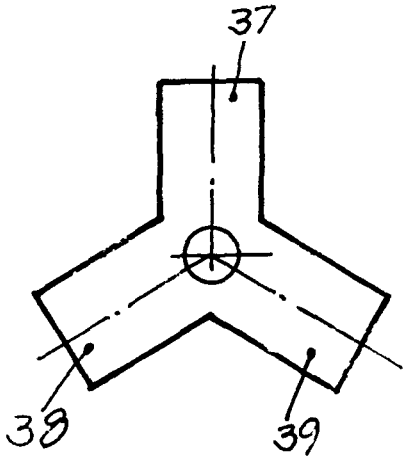
Figures 3, 5:
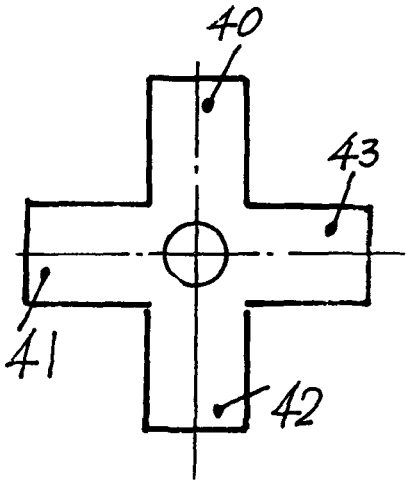

The technical solution about the plurality of work heads is shown in FIG. 5. Of course, as work heads increase, number of holding block members installed on every work head also becomes different. In addition to ordinary flat irons of the mouth of clamp and 'V' shaped holding block members, they will be specially developed under the specific requirements of the shapes of work pieces, also including the holding block (3), installed on the work head (4.2) which is fixed firmly on the left end of the fixed clamp body (4), being changed freely under the requirement of the shapes of the work pieces.

The holding accessories on the fixed clamp body (4) can be developed to rectangles, thus the workplace in direct contact with the work pieces becomes a flat (3.1). Now, if that flat (3.1) is being a common holding workplace, then, under an unchangeable condition, the rectangular holding accessories, by different shapes of every kind of work piece, will be developed into many kinds of combinations, matched with their differently shaped holding members installed on every work head of the left part of the movable clamp body, respectively. The combinations are showing below: a. as shown in FIG. 6-1, the holding members are developed into the combination of (2) and (3) if a rectangular work piece (24) is held; b. as shown in FIG. 6-2, the holding members are developed into the combination of (12) and (3) if a tubular or cylindrical work piece (21) is held; c. as shown in FIG. 6-3, the holding members are developed into the combination of (27) and (3) if a flange work piece (26) is held; d. as shown in FIG. 6-4, the holding members are developed into the combination of (29) and (3) if a polygonal work piece (28) is held; e. as shown in FIG. 6-5, the holding members are developed into the combination of (31) and (3) if an irregular polyhedron work piece (30) is held; among others. However, for the holding of more complicated work pieces such as a connector (44) of oil pipe as shown in FIG. 7, such a technical solution should be taken, that both holding member (33) on the movable clamp body and holding accessory (34) on the fixed clamp body need to be changed simultaneously, or that only the holding accessory on the fixed clamp body has to be changed while another holding member fitted with it still remains on one work head of the movable clamp body, unchangeable, etc.

Embodiment III

Another preferable example in the present invention is that, one of Invention patent series in the eighth generation of 'Fan's Rapid and Automatic Opening and Closing Nuts' which has been patented in more than 20 countries under PCT, 'Screws Mechanism of Flexible Automatic Mated Rapidly Adjusting Distance' discloses a nut (22), which can be installed on the multifunctional bench clamp of the present invention as shown in FIG. 3-1, in place of a typical nut (10). The bench clamp will become 'Fan's Fast Material-saving and Energy-saving Multifunctional Bench Clamps', as shown in FIG. 4.

The nut (22) can be installed firmly within a simply structured and fixed sleeve (23) with a flange, and can be fixed with a screw (45) onto the right end surface of the fixed clamp body (4) to have even force effect. Because axial pull forces which are affected to the nut evenly transmit onto the fixed clamp body (4), drawbacks of airborne structure of a typical nut in a single hanging armed force effect mode can be overcome, and, therefore, the size can be developed smaller, thus saving raw materials. 'Fan's Fast Material-saving and Energy-saving Multifunctional Bench Clamp' has characteristics in use, as follows: in addition to the remaining of the whole characteristics of the multifunctional bench clamp as shown in FIG. 3, one more rapid function is being added, that it just takes 1-2 seconds to clamp or release a work piece. Its operational process is as below:

If handle (13) shown in FIG. 4 rotates one circle in a counter clockwise direction, then the movable clamp body (1) can be fast and freely pushed or pulled. If, after a work piece is taken between holding members (12) and (3), the movable clamp body (1) is pushed to the right so as to make holding member (12) easily push the work piece to holding surface (3.1) of iron of the mouth of clamp (3), handle (13) is operated at once to rotate in a clockwise direction, thereby taking just 1-2 seconds to hold the work piece firmly between the two holding block members (12) and (3), thus increasing efficiency and effectiveness of clamping or releasing the work piece over 10 times. Briefing the advantage of the present invention, it can save a lot of raw materials. In comparison with an old multifunctional bench clamp, when the size and rated clamping force are the same, raw materials can be saved by about 30%. Therefore, the new structure typed multifunctional bench clamp can be called as 'a material-saving and energy-saving multifunctional bench clamp'.

Although the present invention has been described in detail in cooperation with physical embodiments, it is however apparent that change, such as interchange between outer and inner screw threads, variation of shapes of holding accessories or members, etc., is not limited by this description. Persons in this art can take place of all technical identities and their combinations according to their knowledge, but all of those fall within the scope of the claims of this invention.

We claim:

1. A material-saving and energy-saving multifunctional bench clamp, comprising:

a movable clamp body;

a fixed clamp body; and a transmission screw and a nut, said fixed clamp body being provided with a single holding accessory and a retractably movable locating-guiding apparatus, said retractably movable locating-guiding apparatus extending through said fixed clamp body, said movable clamp body being comprised of two parts, a left part and a right part, said right part being comprised of a cylinder guide rail slideable into an inner opening of the fixed clamp body, wherein said left part is provided with at least two work heads, each of the heads having a set of holding members installed thereon respectively, said holding accessory installed on said fixed clamp body being removably aligned with each of said set of holding members, so as to clamp a work piece between said movable clamp body and said fixed clamp body, and wherein an outer surface of said cylinder guide rail on said right part of said movable clamp body is provided with at least two longer-journeyed, axially locating-guiding key grooves cooperative with said retractably movable locating-guiding apparatus and corresponding to each of the heads on said left part, the key grooves extending along a partial length of said cylindrical guide rail toward said nut.

2. The bench clamp of claim 1, wherein each holding member of said movable clamp body has a shape selected from a group consisting of: an iron jaw clamp block, V-shaped holding block, semi-circular holding block, curved holding block and spherical holding block.

3. The bench clamp of claim 1, wherein said holding members of said movable clamp body are changeable.

4. The bench clamp of claim 1, wherein each holding member of said fixed clamp body has a shape selected from a group consisting of: an iron jaw clamp block, V-shaped holding block, semi-circular holding block, curved holding block and spherical holding block.

5. The bench clamp of claim 1, wherein said holding members of said fixed clamp body are changeable.

* * * * *